US005820941A

United States Patent [19]

Felton et al.

[11] Patent Number: 5,820,941

[45] Date of Patent: Oct. 13, 1998

[54] POWDER SPRAY COATING

[75] Inventors: Harry-Graham Felton, Lichfield, England; Jan Ruud, Hjalteby, Sweden

[73] Assignee: Nordson Corporation, Westlake, Ohio

[21] Appl. No.: 619,734

[22] PCT Filed: Sep. 13, 1994

[86] PCT No.: PCT/GB94/01991

§ 371 Date: May 28, 1996

§ 102(e) Date: May 28, 1996

[87] PCT Pub. No.: WO95/08397

PCT Pub. Date: Mar. 30, 1995

[30] Foreign Application Priority Data

Sep. 22, 1993 [GB] United Kingdom ..... 9319605

[51] Int. Cl.[6] ..... B05D 1/04; B05D 1/06; B05B 5/04; B05B 5/047

[52] U.S. Cl. ..... 427/476; 427/475; 427/483; 427/484; 427/480; 427/181; 427/201; 427/421; 118/621; 118/622; 118/625; 118/626; 118/310; 118/311; 118/317; 239/697; 239/698

[58] Field of Search ..... 427/458, 472, 427/473, 474, 475, 476, 477, 478, 479, 480, 481, 482, 483, 484, 421, 426, 181, 201; 118/622, 626, 621, 625, 317, 310, 311; 239/690, 694, 697, 698

[56] References Cited

U.S. PATENT DOCUMENTS

| | | | |
|---|---|---|---|
| 2,893,893 | 7/1959 | Crouse | 427/476 |
| 3,196,826 | 7/1965 | Norris | 118/622 |
| 3,521,815 | 7/1970 | Szasz . | |
| 3,667,674 | 6/1972 | Parsons et al. . | |
| 3,746,254 | 7/1973 | Duncan et al. . | |
| 3,767,116 | 10/1973 | Clausen et al. . | |
| 3,873,024 | 3/1975 | Probst et al. . | |
| 3,924,810 | 12/1975 | Otterstetter . | |
| 4,072,129 | 2/1978 | Bright et al. | 118/629 |
| 4,092,440 | 5/1978 | Wohr et al. | 427/33 |
| 4,109,027 | 8/1978 | Crose | 427/28 |
| 4,248,379 | 2/1981 | Hollstein et al. . | |
| 4,343,436 | 8/1982 | Lehmann . | |
| 4,380,320 | 4/1983 | Hollstein et al. . | |
| 4,543,274 | 9/1985 | Mulder . | |
| 4,810,521 | 3/1989 | Robertson | 427/31 |
| 4,811,898 | 3/1989 | Murphy . | |
| 5,102,045 | 4/1992 | Diana | 239/3 |

FOREIGN PATENT DOCUMENTS

| | | |
|---|---|---|
| 2583310 | 12/1986 | France . |
| 2930121 | 2/1981 | Germany . |
| 55-039262 | 3/1980 | Japan . |
| 1270452 | 4/1972 | United Kingdom . |
| 2230715 | 10/1990 | United Kingdom . |
| 2259657 | 3/1993 | United Kingdom . |
| 95/08397 | 3/1995 | WIPO . |

*Primary Examiner*—Michael Lusignan
*Assistant Examiner*—Michael Barr
*Attorney, Agent, or Firm*—Rankin, Hill, Porter & Clark LLP

[57] ABSTRACT

Apparatus for powder spray coating comprises means (4) for electrostatically-charging powder entrained in air, a conduit (6) for transporting the electrostatically charged powder from the charging means (4) to an internal chamber (12) in a spray head (8), the spray head (8) having at least one passage (16) from the internal chamber (12) to at least one nozzle (17) from which the powder is discharged, and a deflector (18) mounted externally of the spray head (8) and adjacent to the or each nozzle (17) to deflect the discharged powder into a flat spray pattern, the spray head (8) and the flat spray pattern being substantially symmetrical about a common longitudinal axis. The apparatus is particularly suitable for coating a large surface area, or a plurality of small objects hung in a planar array. Preferably multiple triboelectric type charging means (4) are used and a single pump is used to supply powder to the multiple charging means through a common distributor. After passing through the multiple charging means (4) the powder flows are then recombined and sprayed through a common nozzle.

16 Claims, 5 Drawing Sheets

POWDER SPRAY COATING

This invention relates to apparatus and methods for powder spray coating a large surface area, such as the internal or external surface of a cylindrical drum or barrel, large panels, or a plurality of small objects hung in a planar array, for example.

In accordance with conventional powder coating methods and apparatus, a pressurised electrostatically charged mixture of gas and powder particles is sprayed outwardly from a gun in the direction of an object to be coated. The charged powder particles in the mixture repel one another as they travel toward the object to be coated, and the lower electrical potential of the object to be coated electrostatically attracts the particles.

When powder coating an object having a large surface area using a single spray device either the spray device or the object must be moved so as to coat the whole area, or the spray device must discharge a large volume of powder in a wide spray pattern. Moving a single spray device or an object so as to coat a large area takes a considerable time and reduces the maximum throughput of a powder coating system. Discharging a large volume of powder requires a large volume of entraining air, and, due to the large cross-sectional spray area produced by conventional high volume spray devices, the sprayed mixture produces a thick air cushion. This air cushion obstructs the flow of subsequent powder particles and causes a substantial number of these to rebound away from the surface to be coated. As a result, this method of powder coating takes additional time to ensure complete coating and significant amounts of powder are lost due to rebounding.

GB-A-2127370 discloses a dispenser of powdered electrostatic varnish in which powder in admixture with air is fed into a reservoir and thence through a gap defined between two flat parallel surfaces to be dispensed in a flat spray pattern. A number of electrodes are arranged radially adjacent the gap to charge the powder emitted therefrom electrostatically.

Conventional electrostatic powder coating methods and apparatus present further problems when coating a large surface area. When using an external electrode to establish an electrostatic field between the spray device, or gun, and the object, the strongest lines of electrostatic force are located along the direct line between the electrode and the nearest point on the object, and electrostatic lines of force directed towards the more distant portions of the surface to be coated will be significantly weaker, with the result that the object is coated unevenly, with a varying depth of powder since the charged powder follows the electrostatic field lines to the object being coated. Additionally, particles having a higher electrostatic charge retain their charge after deposition, thereby repulsing subsequent particles and resulting in uneven coating.

SUMMARY OF THE INVENTION

In accordance with a first aspect of this invention, powder spray coating apparatus comprises means for supplying electrostatically-charged powder entrained in air to a spray head having at least one nozzle from which the powder is discharged, and a deflector mounted externally of the spray head and adjacent to the or each nozzle to deflect the discharged powder into a substantially flat thin spray pattern, the spray head and the flat spray pattern being substantially symmetrical about a common longitudinal axis.

Preferably means are provided for moving the spray head and the deflector along the longitudinal axis so as to powder coat an object having a large surface area. Alternatively, the object(s) to be coated may be moved, relative to the spray body along the longitudinal axis. By providing relative movement along the longitudinal axis between the spray head and the object(s) to be coated, objects having a large surface area, such as the inside or outside surface of a drum or barrel, or the surface of a large flat object which is moved around the spray device along an omega shaped track, for example, may be coated with powder. Such an apparatus may also be used, in conjunction with an Omega-shaped track, such as that shown in GB 2144349A, to coat a large number of small objects arranged on hangers or a series of larger objects such as panels or extrusions, for example. The spray head and the deflector may be reciprocated vertically so that the sprayed powder traverses the length of vertical and/or moving object(s).

Such an arrangement improves the uniformity in the powder coating of large surface areas and, because the powder particles are electrostatically charged before they are discharged from the spray head there is no requirement for external charging electrodes, and therefore this cause of non-uniformity of coating is substantially eliminated.

In accordance with a second aspect of this invention, powder spray coating apparatus comprises means for supplying a flow of electrostatically-charged powder entrained in air to an internal chamber of a spray head, an internal deflector mounted within the chamber to deflect the flow of air-entrained powder towards at least one spray nozzle from which the powder is discharged and an external deflector mounted adjacent the or each nozzle to deflect the powder into a substantially flat, thin spray pattern, the spray head, the internal deflector, the external deflector and the flat spray pattern being substantially symmetrical about a common longitudinal axis.

Preferably the internal chamber is configured so as to ensure that, where the flow of air-entrained charged powder enters the chamber in a number of streams, the streams impinge and mix thoroughly, before the flow is deflected by the internal deflector, to homogenize the later discharge of powder from the gun in an even, flat and thin 360° spray pattern.

Thorough mixing of a number of streams of air-entrained powder may be achieved by directing the streams along a tapering inlet passage in the spray head, so that the streams impinge and mix. A conical or frustro-conical guide may be provided in the tapering inlet passage so as to form a converging annular passage along which the streams are directed.

With such an arrangement a number of devices may be used electrostatically to charge the powder particles upstream of the spray head, thereby permitting several charging devices, which individually are not capable of electrostatically charging the large volume of powder required to coat a large surface area, to be used in parallel for the discharge of powder through a single spray device. Furthermore the electrostatic charging of the powder particles upstream of the spray head obviates the requirement for external electrodes, thereby improving the uniformity of the coating applied.

Where a number of electrostatic charging devices are employed, an inlet distributor may be used so that it is not necessary to have a dedicated pump to supply each charging device with powder. The inlet distributor is supplied with air-entrained powder by a single pump and acts to deflect the flow into a number of separate streams, corresponding to the number of charging devices. The inlet distributor preferably comprises features similar to those for deflecting the flow of air-entrained powder within the spray head of the apparatus in accordance with the invention. Means may be provided to introduce a flow of air into the inlet distributor so as to accelerate the flow of air-entrained powder and to assist in the thorough mixing of the powder by breaking up agglomerates and removing any powder which may accumulate on the inner surfaces of the inlet distributor.

Such an inlet distributor has the advantage that the cost of the apparatus is significantly reduced since only a single pump is required, rather than a pump for each charging device.

The nozzles may be in the form of a series of holes or slots disposed about the circumference of a circle centered on the longitudinal axis and so configured as to discharge the powder radially outwardly at an angle thereto towards the deflector, or there may be a single nozzle in the form of an annulus, similarly configured to as to direct the powder outwardly.

The external deflector may be in the form of a disc which may be mounted so as to be axially movable with respect to the nozzle (s) in order to set the angle of the flat spray pattern at 90° to the longitudinal axis of the device or to vary the thickness of the spray pattern. Powder discharged from the nozzle (s) impinges on the external deflector and is deflected outwardly in a flat spray pattern. Preferably means are provided to move the spray head and the deflector along the longitudinal axis so that the thin flat spray pattern impinges on and coats a large surface area. Suitably means are provided to reciprocate the apparatus so as rapidly to coat a succession of objects having a large surface area with a uniform coating of powder in an automated process.

The electrostatic charging means preferably comprises one or more frictional charging devices of the type such as those disclosed in British Patent Application Nos. 2066703 or U.S. patent application No. 956,615, which was filed on the 5th Oct. 1992, in which the powder particles become electrostatically charged by multiple frictional contacts with a tortuously configured polytetrafluoroethene conduit. The outlets of one or more of these charging devices may be connected to supply a large volume of charged powder to the internal chamber of the spray head so as to coat a large surface area with a single spraying device.

A method of powder coating a large surface area in accordance with the invention comprises electrostatically charging powder particles entrained in a flow of air, in one or more separate changing devices, conducting the mixture of air-entrained charged powder to a common spray device from the separate charging devices, deflecting the flow of the mixture radially outwardly to form a substantially flat thin spray pattern and moving the spray device so as to reciprocate the thin flat spray pattern over the surface.

The methods and apparatus of this invention are particularly suitable for rapidly applying a powder coating of uniform thickness to a large surface area, particularly to the inside surface of a large container such as an oil drum for example. More particularly, electrostatically charging the powder before it is discharged from the spray device reduces the Faraday cage effect and removes the electrostatic effects described above which produce a non-uniform coating.

BRIEF DESCRIPTION OF THE DRAWINGS

The invention will now be described by way of example and with reference to the accompanying drawings in which.

DETAILED DESCRIPTION OF THE INVENTION

Figure 1:
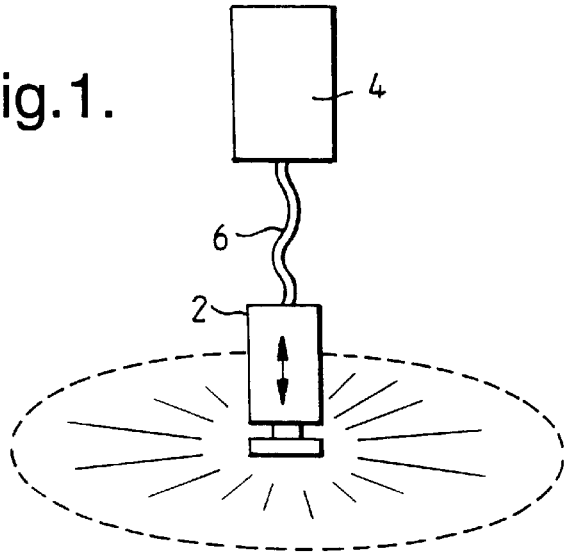
FIG. 1 is a schematic diagram of a powder coating apparatus in accordance with the invention.

The powder coating apparatus shown in FIG. 1 comprises a spray device 2 which is adapted to produce a thin circular spray pattern and which is provided with means (not shown) to reciprocate along an axis perpendicular to the plane of the spray pattern as shown by the arrows. The spray device 2 is supplied with electrostatically charged powder entrained in air from charging apparatus indicated generally at 4. The charging apparatus 4 may be mounted remotely from the spray device and connected thereto by flexible hose 6, or it may be mounted adjacent to the spray device 2 (not shown) so that it can be reciprocated therewith.

Figure 2:
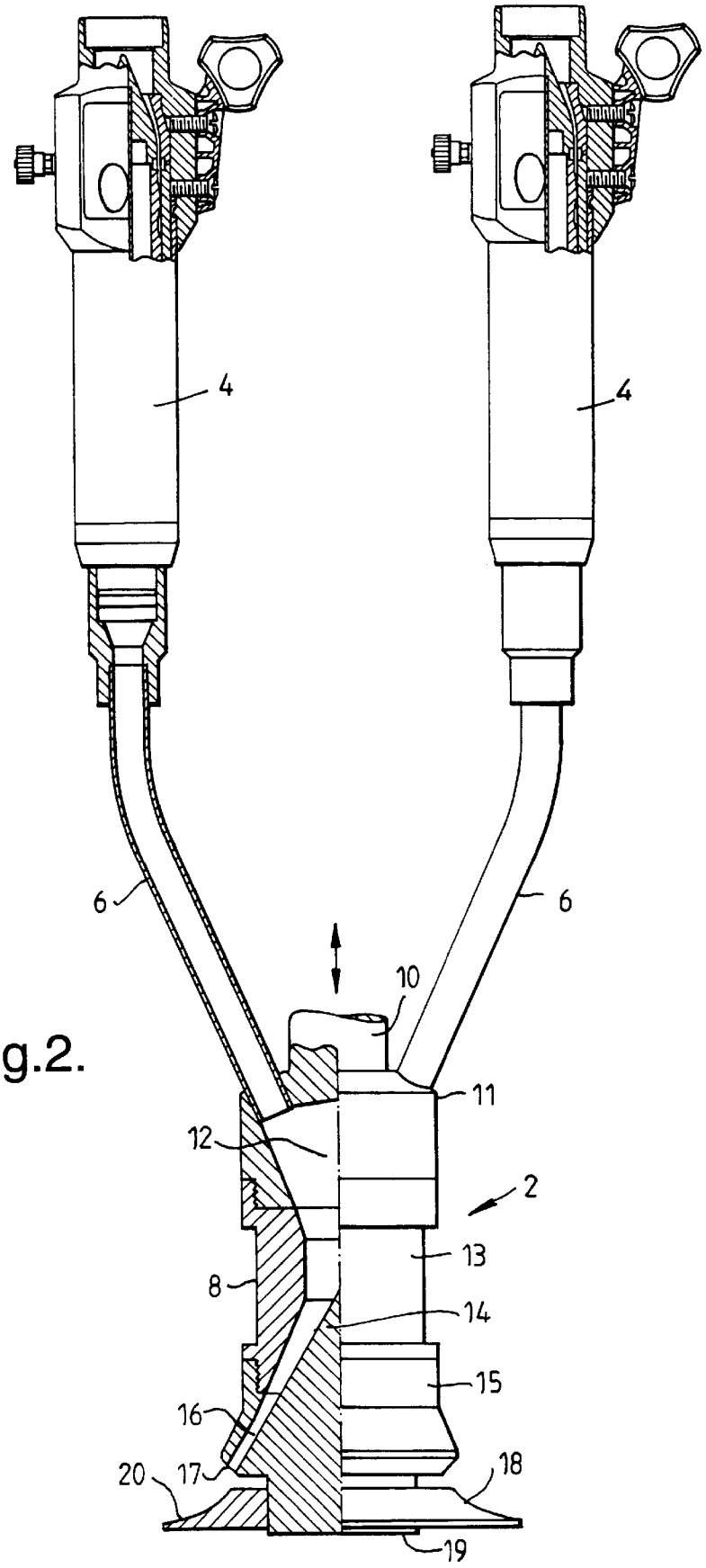
FIG. 2 is a view, in partial cross-section of the apparatus of FIG. 1.

Turning now to FIG. 2, the spray device 2 comprises a spray head 8 which is mounted to support shaft 10 by which the device 2 may be moved. Electrostatically-charged air-entrained powder particles are supplied from two charging devices 4 via conduits 6 to an inlet collar 11 disposed at the end of support shaft 10. Inlet collar 11 includes the upper portion of a mixing chamber 12. The lower portion of mixing chamber 12 is contained in mixing chamber housing 13 which is secured to inlet collar 11. From chamber 12 the flow of charged powder particles is deflected outwardly by a conical deflector 14 which forms a part of distributor 15 which is secured to mixing chamber housing 13. Distributor 15 includes a plurality of circular spray nozzles 17 disposed in a circle about the longitudinal axis of the device 2. A plurality of passages 16 connect each of the nozzles 17 to the mixing chamber 12. Charged air-entrained powder particles are discharged from the nozzles 17 towards a disc deflector 18 frictionally mounted on stub 19 of distributor 15, which has a radiused annular surface 20 to deflect the powder particles radially outwardly to form a substantially flat thin spray pattern in the form of a 360° circle at 90° to the longitudinal axis of the device 2. The deflector 18 is adjustably mounted so as to be axially movable with respect to the spray head 8 in order to set the angle of the flat spray pattern at 90° to the longitudinal axis of the device 2, taking into account the velocity at which the powder is discharged from the nozzles 17 and the size and/or density of the powder particles, or to adjust the thickness of the spray pattern, or to accommodate changes in the type of powder and/or the pressure of the entraining air. The disc deflector 18 may also be replaced with another having an annular surface 20 of a greater or lesser radius for the same purpose. Additionally, it will be appreciated that the flat spray pattern could be moved through a small angle by moving the deflector disc 18 axially relative to the spray head 8.

Figure 3:
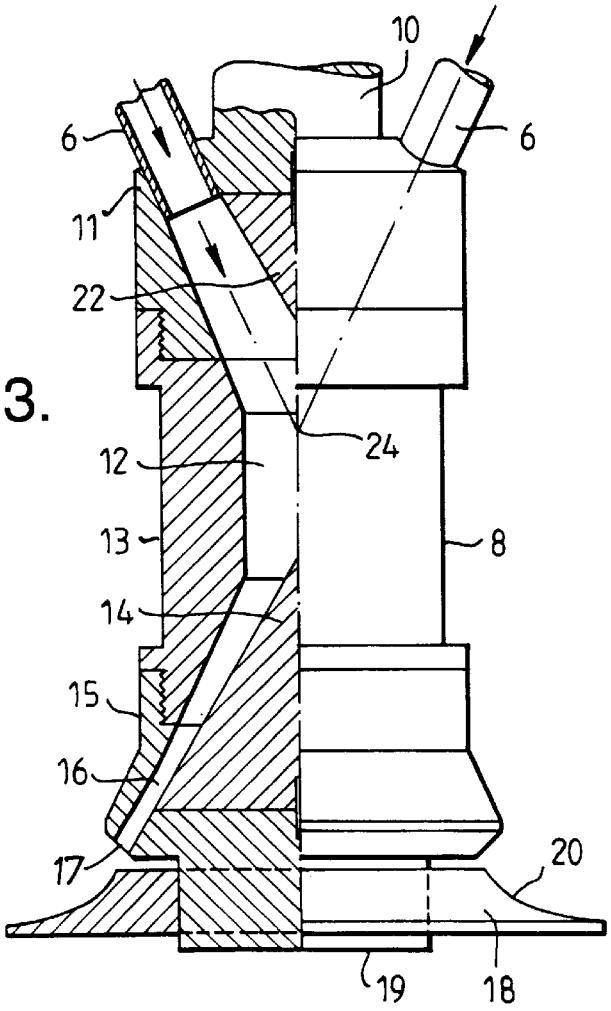
FIG. 3 is a view, in partial cross section, of an alternative form of powder spray head to that shown in FIG. 2.

FIG. 3 illustrates an alternative form of powder spray head 8, wherein like numerals refer to the same features as shown in the spray head of FIG. 2. A conical guide 22 is secured to inlet collar 11 to project into the internal chamber 12 to guide the separate flows of air-entrained, electrostatically-charged powder (indicated by arrows) from each of the conduits 6 (only two are shown) so that they impinge and mix thoroughly at a point 24 within the chamber 12 before the flow of powder is deflected by deflector 14. The conical guide 22 also prevents powder from accumulating on those surfaces of the chamber 12 which are not in the flow path of the air-entrained powder, which accumulated powder could break off in lumps and lead to one or more of the nozzles 17 becoming blocked, or to a non-uniform coating being applied to an object. Any powder which adheres to the surface of the chamber 12 as shown in FIG. 3 is cleared by the air-entrained powder flowing thereover.

Mixing the separate powder flows thoroughly in this way ensures that the powder discharged from the nozzles 16 is homogeneously electrostatically charged and evenly distributed in the spray pattern, and accommodates any discrepancies in powder flow rate and/or electrostatic charging produced by the separate charging devices.

The charging device(s) 4 are preferably of the type described in British Patent Application No. 2066703 or U.S. patent application No. 956,615, in which powder particles flowing therethrough are electrostatically charged by multiple frictional contact with the walls of the device. Although only two such charging devices 4 are shown, it will be clear that there may be fewer or more such devices according to the desired powder throughput of the spray device and the capacity of each charging device.

The charging devices 4 may be statically mounted and connected to the spray device 2 by flexible hoses 6 so that the spray device 2 may be reciprocated in order that the flat spray pattern produced passes over, and coats with powder, a large surface area, or the charging devices 4 may be mounted so as to reciprocate with the spray device 2.

In either case, the flat spray pattern produced by the spray device produces a thin line of powder of uniform thickness where the spray pattern impinges upon the surface of the object to be coated. In order to coat a large area it is necessary to cause the flat spray pattern to move, preferably along an axis perpendicular to the plane of the spray pattern, so that the thin line of powder coating moves over and coats the surface of the object. This is conveniently achieved by reciprocating the spray device 2, with or without the charging devices 4, by manipulating the support shaft 10 with a mechanical device (not shown) such as a reciprocating gun mover or robot arm, for example.

Figure 4:
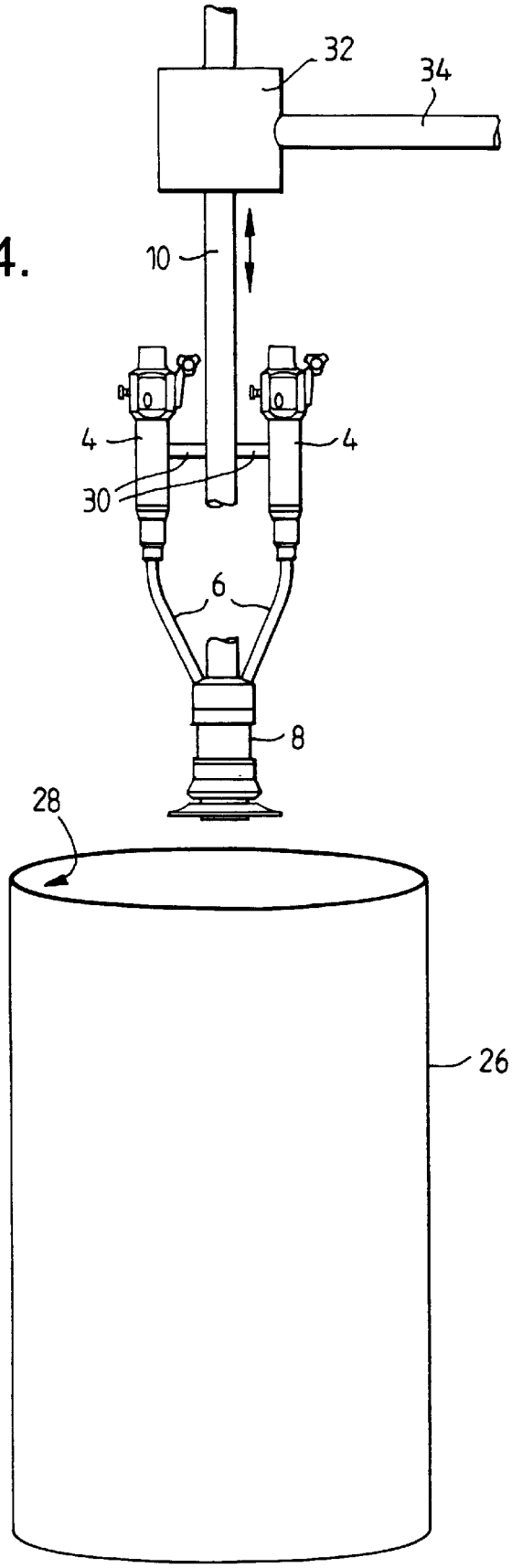
FIG. 4 is a schematic drawing, showing the apparatus of FIG. 2 mounted to a reciprocating arm for coating the interior of an oil drum.

FIG. 4 illustrates schematically the apparatus of FIG. 2 mounted so as to reciprocate in the direction of the arrows in order to lance into, and out of, an open-ended oil drum 26 so as to coat the interior 28 thereof with powder. The charging devices 4 are mounted by brackets 30 to the support shaft 10 which is reciprocated by a motor 32, so that the spray head 8 and the charging devices 4 lance into the drum 26. Whilst the spray head 8 is being lanced into the drum 26, it is actuated so as to discharge powder to coat the interior surface 28 of the drum 26. On reaching the bottom of the drum, the discharge of powder may be interrupted and the spray head 8 withdrawn, or the powder may continue to be discharged as the spray head 8 is withdrawn so as to provide a thicker coating of powder on the internal surface 28 of the drum 26. Once the spray head 8 has been withdrawn, the coated drum 26 may be removed and replaced by a new drum 26 and the process begun anew.

The reciprocating motor 32 is suitably mounted to a bracket 34 which may be mounted to the wall of the powder spray booth (not shown), and flexible conduits and cables (not shown) are provided to supply the charging devices 4 with high pressure air, powder and electrical power. Means are also provided (not shown) to ground the oil drum 26 so that the electrostatically charged powder emitted from the spray head 8 is attracted, and adheres, thereto.

Figure 5A:
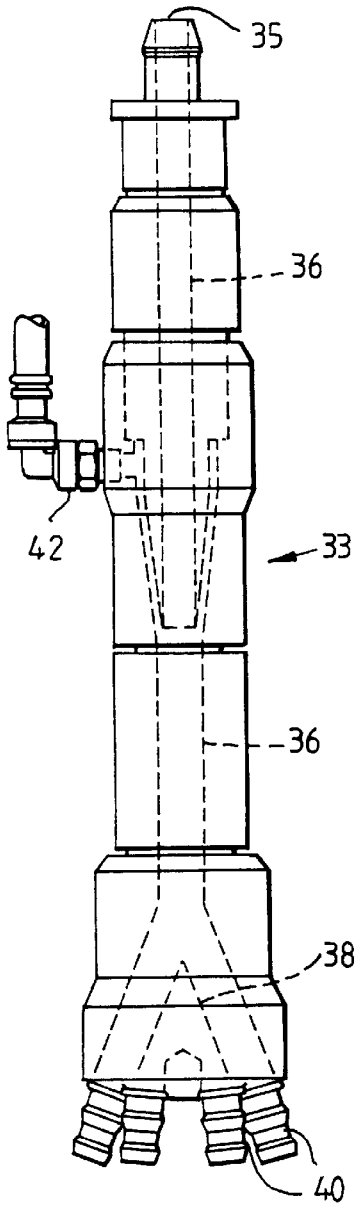
FIGS. 5*a* and 5*b* are, respectively, an elevation view and an exploded view of an inlet distributor for directing a single flow of air into a number of electrostatic charging devices.

FIG. 5*a* shows an inlet distributor 33 for deflecting a single flow of air-entrained powder into a number of separate streams, each of which may then be directed through a separate charging device, as illustrated in FIG. 4. The inlet distributor 33 comprises several modules 331, 332, 333, 334 (shown in FIG. 5*a*). Air-entrained powder is supplied to the inlet 35 of the distributor 33 by a suitable pump (not shown) and along an internal flow passage 36. At the downstream end of the passage 36 is a deflector 38, which deflects the flow to a number of outlets 40, each of which is connected to a charging device 4.

Figure 5B:
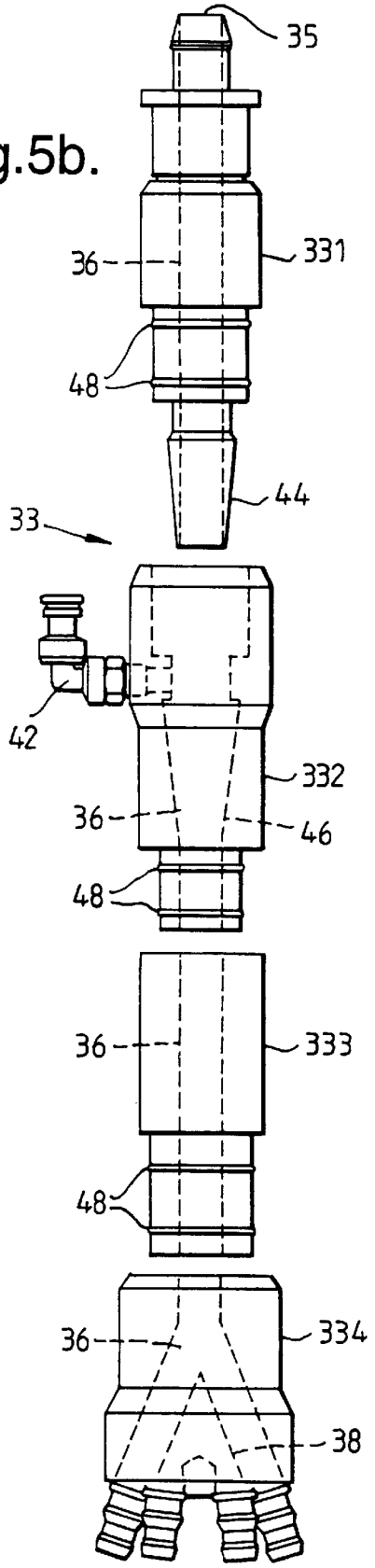

To accelerate the flow of air-entrained powder, pressurised air is introduced to the inlet distributor 33 through an air inlet 42. Referring now to FIG. 5*b*, air inlet 42 is located on module 332 and air from the inlet 42 enters the passage 36 along a converging annular passage formed between tapering inner and outer surfaces 46, 44 which are provided on modules 332 and 331 respectively. Air emerging from this converging annular passage enters passage 36, which continues through each module, and accelerates the powder flow. The modules are connected together and an air-tight seal is provided between the modules by means of O rings 48.

Figure 6:
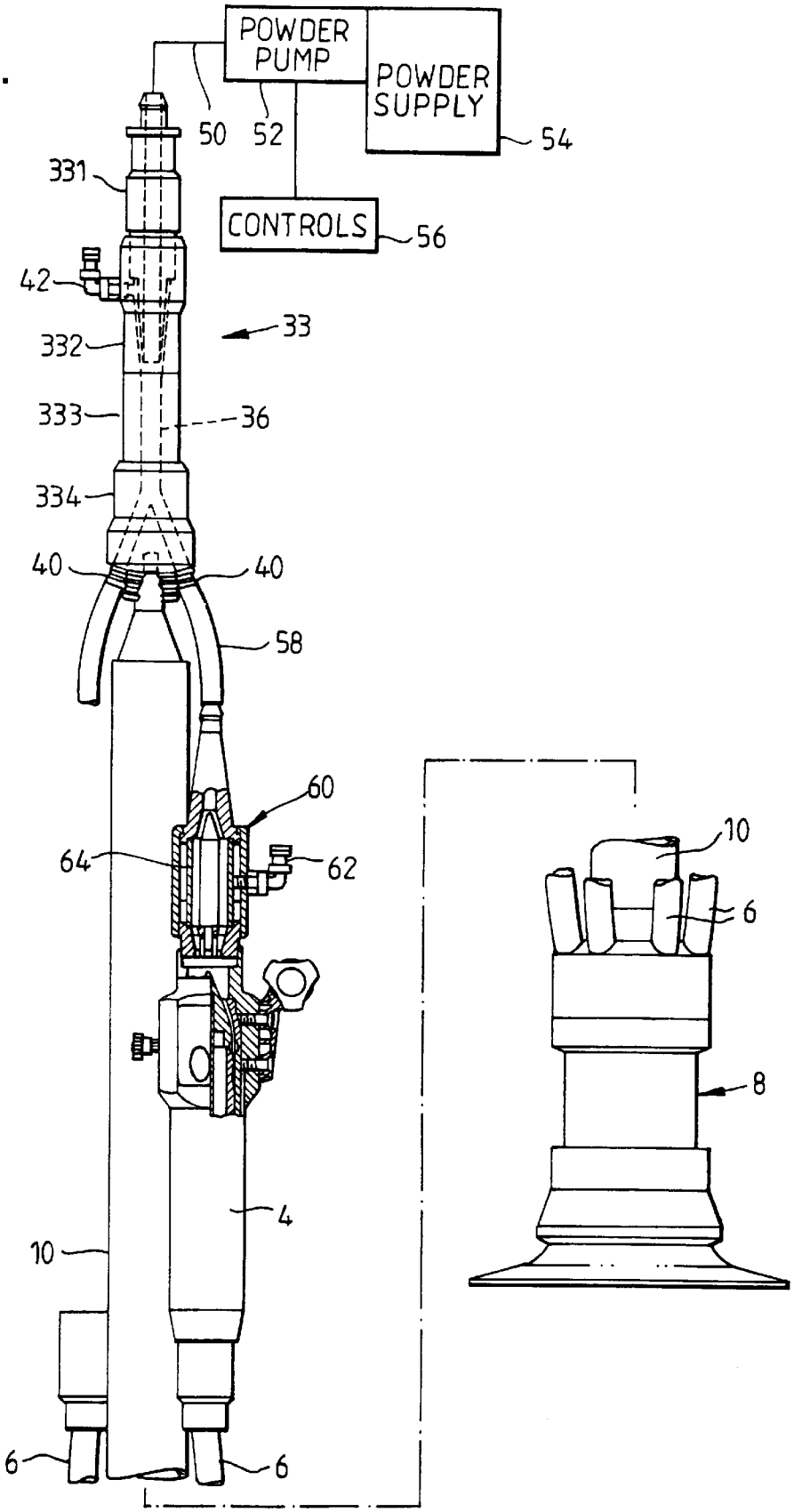
FIG. 6 is a view of apparatus in accordance with the invention incorporating the inlet distributor of FIGS. 5*a* and 5*b*.

FIG. 6 shows an apparatus in accordance with the invention, incorporating six tribo-electric charging devices (only one is shown, for clarity) and incorporating an inlet distributor 33. Although six charging devices 4 are used with the system illustrated in FIG. 6, there could be fewer or more, in which case the appropriate number of outlets 40 are provided and are preferably disposed equally around the longitudinal axis so that the flows through the charging devices 4 are substantially the same.

As diagramatically illustrated in FIG. 6, a powder hose 50 preferably supplies powder coating material from a single pump 52 connected to a common powder supply 54 and controlled by controls 56. The powder flow supplied by pump 52 through hose 50 is divided by inlet distributor 33 into the six outlets 40.

The powder then passes from outlets 40 through the hoses 58 attached to each outlet 40 and from each hose 58 into the charging device 4 connected to each hose 58. A diffuser 60 is preferably located between each hose 58 and the associated charging device 4.

Each diffuser 60 includes a compressed air inlet 62. Compressed air introduced through inlet 62 passes through a porous sleeve 64 before intermixing with the air-powder mixture from hose 62 which is passing through the centre of diffuser 60 before entering charging device 4. The function of diffuser 60 is to ensure the uniform distribution of the flow of air-entrained powder entering the inlet of the charging device and further to promote the uniform distribution of powder within that flow. By accelerating the flow, the diffuser 60 also acts to break up any powder agglomerates and to prevent the accumulation of powder on the inner surfaces of the charging device 4.

The powder is charged in device 4 as previously described and then passes through the hose 6 associated with each device 4, and then from each of the hoses 6 into the common spray head 8 where the six individual powder flows are recombined and sprayed from spray head 8 in a single, large radial pattern such as for coating the interior of a drum.

Thus, a single pump 52 having one set of controls 56 can be used to discharge a high flow rate of electrostatically charged powder through a single spray device in accordance with the teachings of this invention. This reduces the amount of investment and degree of complexity which would be required if a dedicated pump and set of controls were required for each charging device 4.

A method and apparatus for powder spray coating in accordance with the invention enables the coating of large surface areas with a uniform coating of powder with a minimum of powder loss through rebounding or deflection, and is particularly suitable for coating the inside of large cylindrical containers such as oil drums for example or for coating objects, such as long vertically hung extrusions, which are transported along an omega track around a spray station having such a spray device. In addition, the use of low-voltage frictional devices to electrostatically charge the air-entrained powder provides improved safety by reducing the spark hazard arising with a conventional high-voltage powder charging device utilising external electrodes in an enclosed space such as an oil drum filled with combustible powder. The use of an inlet distributor to distribute the flow of air-entrained powder evenly through several charging devices enables the powder to be supplied by a single pump, rather than the more costly alternative of providing a separate pump for each charging device as previously mentioned.

We claim:

1. Apparatus for powder spray coating, comprising:

two or more charging devices to apply an electrostatic charge to the powder;

two or more conduits for transporting the electrostatically charged powder from the charging devices to an internal chamber in the spray head, each of the charging devices having a separate conduit to the chamber, the internal chamber being spaced from the charging device, the spray head having at least one passage from the internal chamber to one or more nozzles from which the powder is discharged, wherein means are provided within the chamber to guide the separate flows of powder so that they impinge and mix before the combined flow is deflected outwardly towards each of the one or more nozzles; and a deflector mounted externally of the spray head and separate from but adjacent to each of the one or more nozzles and separate from the charging device to deflect the powder after it has been discharged from the nozzle(s) into a flat spray pattern, the spray head and the flat spray pattern being substantially symmetrical about a common longitudinal axis.

2. Apparatus as claimed in claim 1, where in the deflector is adapted to deflect the discharged powder into a flat spray pattern substantially perpendicular to the longitudinal axis.

3. Apparatus as claimed in claim 1, wherein the nozzles(s) is(are) disposed about the circumference of a circle centered on the longitudinal axis and so configured as to discharge the powder outwardly at an angle to the longitudinal axis toward the deflector.

4. Apparatus as claimed in claim 1, wherein the spray head has a single nozzle in the form of an annulus.

5. Apparatus as claimed in claim 1 wherein each of the one or more nozzles is directed outwardly from the longitudinal axis, the spray head comprising a chamber to which the air-entrained, electrostatically-charged powder is supplied and containing an internal deflector to deflect air-entrained powder outwardly toward each of the one or more nozzles.

6. Apparatus as claimed in claim 1, wherein the external deflector is movable along the longitudinal axis.

7. Apparatus as claimed in claim 1, wherein the charging device comprises a frictional, or tribo-electrical, charging device to apply the electrostatic charge to the powder.

8. Apparatus for powder spray coating object(s) as claimed in claim 7, comprising means to produce relative motion along the longitudinal axis between the spray pattern and the object(s) to be coated.

9. Apparatus as claimed in claim 8, wherein the means to produce relative motion comprises means to reciprocate the spray head and external deflector.

10. Apparatus as claimed in claim 1, wherein the flat spray pattern is in the form of a 360° disc.

11. Apparatus as claimed in claim 1 comprising at least two means for electrostatically charging powder, wherein the powder is supplied by a single pump to an inlet distributor comprising a powder flow passage and a deflector within the passage to deflect the flow of air-entrained powder and to separate the flow into a number of substantially equal streams, each stream being directed towards a particular charging device.

12. A method of powder spray coating, comprising:

electrostatically charging air-entrained powder at two or more locations;

guiding separate flows of the air-entrained electrostatically charged powder from each of the locations so that they impinge and mix before the combined flow is supplied to a spray head;

supplying the air-entrained electrostatically charged powder to the spray head spaced from the locations in which the powder is charged;

discharging the charged powder from at least one nozzle; and deflecting the discharged charged powder into a flat spray pattern which is substantially symmetrical about the longitudinal axis of the spray head.

13. A method of powder spray coating an object as claimed in claim 12, comprising reciprocating the spray head so that the flat spray pattern traverses the length of the object to be coated with powder.

14. A method as claimed in claim 12, wherein the flat spray pattern produced is in the form of a 360° disc.

15. A method as claimed in claim 14, wherein the object to be coated is an open-ended drum.

16. A method as claimed in claim 12, wherein the air-entrained powder is charged electrostatically by more than one charging device, the method comprising pumping air-entrained powder from a powder source using a single pump and dividing the flow of powder evenly into a number of separate streams, each stream being directed into a separate charging device.

* * * * *